US009219336B2

(12) United States Patent
Starke

(10) Patent No.: US 9,219,336 B2
(45) Date of Patent: Dec. 22, 2015

(54) SHIELDED PLUG-IN CONNECTOR AND METHOD FOR PRODUCING A SHIELDED PLUG-IN CONNECTOR

(71) Applicant: Cord Starke, Blomberg (DE)

(72) Inventor: Cord Starke, Blomberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 19 days.

(21) Appl. No.: 14/365,658

(22) PCT Filed: Dec. 10, 2012

(86) PCT No.: PCT/EP2012/005104
§ 371 (c)(1),
(2) Date: Jun. 16, 2014

(87) PCT Pub. No.: WO2013/091791
PCT Pub. Date: Jun. 27, 2013

(65) Prior Publication Data

US 2015/0004826 A1 Jan. 1, 2015

(30) Foreign Application Priority Data

Dec. 21, 2011 (DE) ..... 10 2011 056 798

(51) Int. Cl.
*H01R 13/648* (2006.01)
*H01R 13/6581* (2011.01)
(Continued)

(52) U.S. Cl.
CPC ..... *H01R 13/6581* (2013.01); *F01K 3/14* (2013.01); *F01K 3/242* (2013.01); *F01K 7/22* (2013.01); *F01K 13/02* (2013.01); *F22B 1/006* (2013.01); *H01R 4/4872* (2013.01); *H01R 4/64* (2013.01);
(Continued)

(58) Field of Classification Search
CPC ..... H01R 13/648; H01R 4/64
USPC ..... 439/98, 607.41, 607.48, 607.51, 439/607.52; 174/359
See application file for complete search history.

(56) References Cited

U.S. PATENT DOCUMENTS 3,830,957 A * 8/1974 Oberdiear ..... H01R 13/648 174/653
4,213,664 A * 7/1980 McClenan ..... H01R 9/05 439/472

(Continued)

FOREIGN PATENT DOCUMENTS

DE 69417638 T2 12/1999
DE 19849227 C1 4/2000

(Continued)

*Primary Examiner* — Phuong Dinh
(74) *Attorney, Agent, or Firm* — Leydig, Voit & Mayer, Ltd.

(57) ABSTRACT

A method for producing a plug-in connector includes stripping a cable on a free end in a first and second region of a sheath of the cable, where a shield is disposed below the sheath on the cable. The method includes disposing a first electrically conductive spring element in the first region, and removing the sheath and the shield from the second region, thereby forming an end portion of the free end of the cable on which exposed wires of the cable are disposed. The method includes disposing contact elements on the exposed wires, and disposing a shield sleeve around the first electrically conductive spring element. The method includes fastening the shield sleeve on the sheath before and after the first electrically conductive spring element, and providing an insulating housing such that the insulating housing at least partially surrounds the shield sleeve and the free end of the cable.

22 Claims, 7 Drawing Sheets

(51) Int. Cl.

| | |
|---|---|
| ***H01R 4/48*** | (2006.01) |
| ***H01R 4/64*** | (2006.01) |
| ***H01R 9/03*** | (2006.01) |
| ***H01R 9/05*** | (2006.01) |
| ***H01R 13/52*** | (2006.01) |
| ***H01R 13/6582*** | (2011.01) |
| ***H01R 13/6592*** | (2011.01) |
| ***H01R 13/6594*** | (2011.01) |
| ***H01R 13/6596*** | (2011.01) |
| ***H01R 13/74*** | (2006.01) |
| ***F01K 3/14*** | (2006.01) |
| ***F01K 3/24*** | (2006.01) |
| ***F01K 7/22*** | (2006.01) |
| ***F01K 13/02*** | (2006.01) |
| ***F22B 1/00*** | (2006.01) |
| ***H01R 13/62*** | (2006.01) |
| ***H01R 43/20*** | (2006.01) |
| *H01R 4/20* | (2006.01) |
| *H01R 13/46* | (2006.01) |

(52) U.S. Cl.

CPC ..... *H01R 9/034* (2013.01); *H01R 9/037* (2013.01); *H01R 9/0518* (2013.01); *H01R 9/0527* (2013.01); *H01R 13/5216* (2013.01); *H01R 13/62* (2013.01); *H01R 13/6582* (2013.01); *H01R 13/6592* (2013.01); *H01R 13/6594* (2013.01); *H01R 13/6596* (2013.01); *H01R 13/741* (2013.01); *H01R 43/20* (2013.01); *H01R 4/20* (2013.01); *H01R 13/465* (2013.01); *Y10T 29/49174* (2015.01); *Y10T 29/49183* (2015.01)

(56) References Cited

U.S. PATENT DOCUMENTS

| | | | | |
|---|---|---|---|---|
| 4,547,623 | A * | 10/1985 | Van Brunt ..... | H01R 4/646 174/359 |
| 4,810,210 | A | 3/1989 | Komatsu | |
| 5,310,359 | A | 5/1994 | Chadbourne et al. | |
| 6,537,104 | B1 | 3/2003 | Hagmann et al. | |
| 7,416,448 | B2 * | 8/2008 | Gaidosch ..... | H01R 9/031 439/607.41 |
| 7,503,776 | B1 * | 3/2009 | Pavlovic ..... | H01R 4/46 439/455 |
| 2010/0261387 | A1 | 10/2010 | Jordan | |
| 2013/0078846 | A1 | 3/2013 | Sasaki et al. | |

FOREIGN PATENT DOCUMENTS

| | | | |
|---|---|---|---|
| EP | 0207322 | B1 | 1/1987 |
| JP | 2010251127 | A | 11/2010 |
| JP | 2011175764 | A | 9/2011 |
| WO | WO 2010114068 | A1 | 10/2010 |

* cited by examiner

SHIELDED PLUG-IN CONNECTOR AND METHOD FOR PRODUCING A SHIELDED PLUG-IN CONNECTOR

CROSS-REFERENCE TO RELATED APPLICATIONS

This application is a U.S. National Phase application under 35 U.S.C. §371 of International Application No. PCT/EP2012/005104, filed on Dec. 10, 2012, and claims benefit to German Patent Application No. DE 10 2011 056 798.4, filed on Dec. 21, 2011. The International Application was published in German on Jun. 27, 2013, as WO 2013/091791 A2 under PCT Article 21 (2).

FIELD

The invention relates to a shielded plug-in connector and a method for producing a shielded plug-in connector.

BACKGROUND

Plug-in connectors, which are used in particular on wind turbines, need to be as fully shielded as possible in order to effectively divert excess voltage, which can occur as a result of a lightning strike, for example. To this end the shield of the cable, for example in the form of a shielding braid, which surrounds the wires of the cable and is arranged below the sheath of the cable, must be contacted. This is generally only possible with a great deal of complexity. For example, stripping the sheath off the free end of the cable, unbraiding the shielding braid below, turning it down and laying it across the sheath of the cable is known. In order to form a contact, a metal sleeve is then passed over the folded down shielding braid and screwed or crimped to the shielding braid such that the shielding braid is clamped between the metal sleeve and the sheath. This method is often used in the case of coaxial plug-in connectors or moulded plug-in connectors, such as described in EP 0 207 322 B1.

In the case of plug-in connectors that can be freely assembled, the method is either similar or the contact is formed via a spring element, which can be activated via a housing for example, such as described in DE 198 49 227 C1.

The continuation of the shielding is then normally achieved via a screw connection, which corresponds to an appropriate screw part of a mating plug.

One disadvantage of the production methods described above is that they require a lot of effort and cannot be automated. These plug-in connectors are normally assembled manually, which is very especially inefficient in the case of large quantities.

SUMMARY

In an embodiment, the present invention provides a method for producing a plug-in connector. The method includes stripping a cable on a free end in a first and second region of a sheath of the cable, first and second regions of the sheath and a shield disposed beneath the sheath on the cable being cut through. The method includes disposing a first electrically conductive spring element in the first region, and removing the sheath and the shield from the second region so as to form an end portion of the free end of the cable with exposed wires of the cable. The method includes disposing contact elements on the exposed wires, and disposing a shield sleeve around the first electrically conductive spring element. The method includes fastening the shield sleeve on the sheath on either side of the first electrically conductive spring element, and providing an insulating housing at least partially surrounding the shield sleeve and the free end of the cable.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
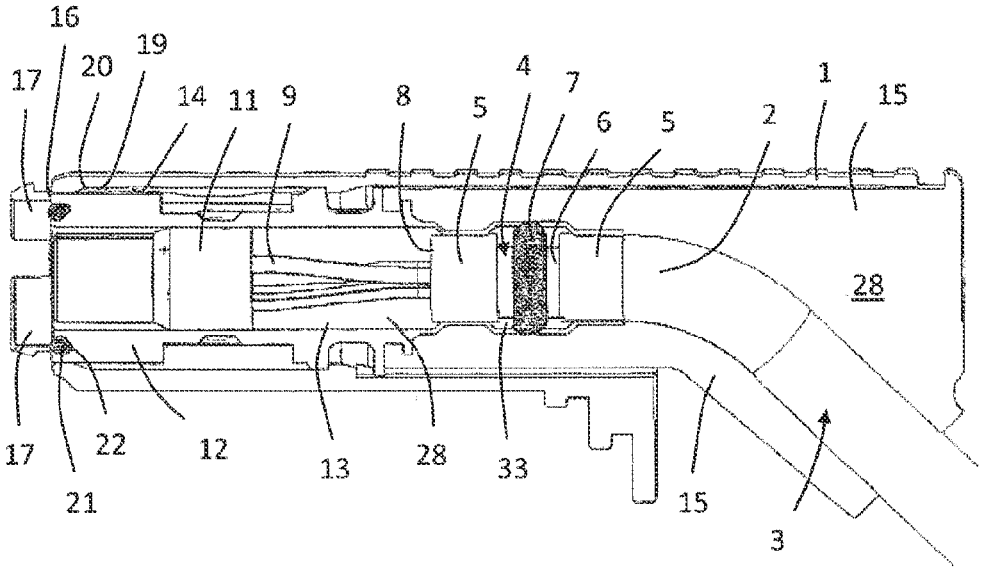
FIG. 1 shows a schematic, sectional view of a plug-in connector according to the invention.

An aspect of the invention provides a method for the production of a shielded plug-in connector that can be automated and as a result, the complexity and costs of production can be reduced such that even large quantities of a shielded plug-in connector can be produced economically.

In an embodiment of a method for producing a plug-in connector, the present invention includes stripping a cable on a free end of the cable in a first region and in a second region, in the first region the sheath of the cable and in the second region the sheath of the cable and the shield formed below the sheath on the cable being cut through; arranging a first electrically conductive spring element in the first region; removing the sheath and the shield from the second region, thereby forming an end portion of the free end of the cable on which the wires of the cable are exposed; arranging contact elements on the exposed wires of the cable; arranging a shield sleeve around the first spring element arranged in the first region; fastening the shield sleeve on the sheath of the cable before and after the first spring element; and arranging an insulating housing such that the insulating housing at least partially surrounds the shield sleeve and the free end of the cable.

In an embodiment of a plug-in connector the present invention includes an insulating housing, inside which a free end of a cable is inserted, a first electrically conductive spring element, which is arranged on a first stripped region of the free end of the cable on the shield surrounding the wires of the cable, a plurality of contact elements, which are connected to the wires of the cable and a shield sleeve, which surrounds the first spring element, the shield sleeve being fastened to the sheath of the cable before and after the first spring element.

The plug-in connector and the method for producing a plug-in connector having a shielded contact formation are characterised in that the production complexity is significantly reduced in comparison to conventional plug-in connectors and now the whole production method can be automated in various work stations, as a result of which the production, especially of large quantities, can be particularly economical.

In the production of the plug-in connector according to the invention, firstly the sheath of the cable to be inserted into the plug-in connector is cut into in two regions, an incision being performed in the first region to the extent that only the sheath is cut into, but not the shield arranged below it. In the second region, which is arranged at a distance from the first region, the shield is also cut into in addition to the sheath. Between the first region and the second region, the sheath and the shield remain intact on the cable. In the first region, the sheath is removed to the extent that a first electrically conductive spring element can be introduced in the first region and rests on the shield of the cable in the introduced state. Before and after the introduced spring element, the cable continues to be surrounded by the sheath of the cable. By cutting through the sheath and shield in the second region, the sheath and shield can be stripped from the cable here such that an end portion of the free end of the cable is formed on which the wires of the cable are exposed. If necessary the now exposed wires are likewise stripped and connected to contract elements, for example by crimping. Then an electrically conductive shield sleeve, which can be produced from a metal die casting for example, is guided over the free end of the cable to the extent that the contact elements and the first spring element are fully covered by the shield sleeve. In order to securely position the shield sleeve, the shield sleeve is fastened to the sheath of the cable before and after the first spring element. The shield sleeve is fastened to the sheath of the cable such that the spring element is tightly sealed as a result as well as a means of strain relief being formed for the cable. An insulating housing is then pushed over the shield sleeve, and covers the shield sleeve and the free end of the cable apart from a small region, the insulating housing resting on the outer circumferential region of the shield sleeve in some regions. In this context, every processing step during the production process can be fully automated such that no manual work has to be undertaken any more, as a result of which the complexity as well as the costs of production and the production time can be reduced.

According to a preferred configuration of the invention, the first spring element is annular, the annular spring element being pushed onto the cable via the free end of the cable and introduced into the first stripped region. The first spring element used is preferably designed in the form of a closed ring, as a result of which the positioning of the first spring element on the first stripped region of the cable can be automated particularly well. Moreover, due to the annular configuration of the spring element a particularly good shield is achieved. The annular spring element is preferably a spiral spring ring.

It is also preferably provided for the shield sleeve to be fastened to the sheath by crimping. By crimping, the shield sleeve can be securely fixed to the sheath of the cable in a short time, it being possible for particularly effective strain relief to be formed simultaneously for the cable on the crimped regions of the cable in the process. Furthermore, as a result of the crimping, where the diameter of the shield sleeve is reduced in this region in that the shield sleeve is pressed onto the sheath preferably in an annular manner over 360°, the shield sleeve is adjusted to the thickness or diameter of the cable, such that any selected cable diameter can be used for the plug-in connector according to the invention.

It is preferably also provided for the first spring element to be tensioned when the shield sleeve is fastened to the sheath of the cable. This is achieved in that when the shield sleeve is fastened to the sheath, preferably by means of a crimping process, the diameter of the shield sleeve is also reduced in the region of the first spring element and thus pressed towards the sheath, as a result of which the shield sleeve presses against the spring element and tensions it such that the first spring element is tensioned by the shield sleeve in the finished assembled plug-in connector.

According to another preferred configuration of the invention, an insulation material is injected into a first space formed between the insulating housing and the free end of the cable arranged in the insulating housing. As a result of the insulation material injected into this first space, the insulation strength of the plug-in connector can be improved. As a result of the injected insulation material, cavities inside the plug-in connector, which are susceptible to water penetration, can be reduced.

It is preferably provided here for there to be at least one opening formed on the shield sleeve, via which the insulation material is injected into a second space forming an interior of the shield sleeve in which the exposed wires of the cable are introduced. The filling up of this second space inside the shield sleeve with an insulation material as well enables the insulation strength of the plug-in connector to be further improved since the number of cavities inside the plug-in connector can hereby be further reduced. Moreover, individual components such as the exposed wires and the contact elements can be permanently fixed.

According to another preferred configuration of the invention, an insulating body is provided into which the contact elements are introduced. When the contact elements are firmly attached to the wires of the cable, an insulating body is passed over the contact elements such that the contact elements are then surrounded by the insulating body. The insulating body preferably has one through-opening per contact element such that the contact elements are arranged separately from each other inside the insulating body.

In order to improve the fixing and thus the positioning accuracy of the shield sleeve inside the plug-in connector, the shield sleeve is arranged around the insulating body in addition to the arrangement around the first spring element, and the shield sleeve is fastened to the insulating body.

The shield sleeve is preferably fastened to the insulating body by crimping. By crimping, the shield sleeve can be securely fixed to the insulating body in a short time. The crimping is preferably carried out in a plurality of regions around the outer circumferential surface of the shield sleeve, the plurality of regions preferably being at selective points.

Another preferred configuration of the invention provides for a second electrically conductive annular spring element to be introduced into a recess formed on the shield sleeve at a free end of the shield sleeve at which the plug-in connector can be fastened to a wall by means of the shield sleeve. In a fastened state of the plug-in connector, the wall of the second spring element, which may be a housing wall for example, rests against the wall, in the case of a wall formed of metal the second spring element acting as a shield such that a shield contact can be formed between the wall and the second spring element. Moreover, the second spring element can take up any clearance formed between the plug-in connector and the wall. The second spring element is preferably designed in the form of a spiral spring ring just like the first spring element.

In order to fasten the plug-in connector to the wall it is preferably provided for locking means to be formed on the free end of the shield sleeve. Because of the locking means, the plug-in connector can be easily and quickly fastened to the wall and also released again with minimal effort in that the locking means engage behind the wall. The locking means are preferably provided in the form of one or more annular locking hooks formed on the end face of the shield sleeve.

Furthermore, it is preferably provided for the insulating housing to be arranged movably on the shield sleeve, it being possible to activate the locking means during a displacement movement of the insulating housing. A dome is preferably formed on the outer circumferential surface of the shield sleeve for this purpose. In order to activate the locking means, the insulating housing having a preferably inclined contact surface, which is formed on the internal wall of the insulating housing, can be passed over the dome of the shield sleeve, which is formed near the locking means, as a result of which the shield sleeve and thus also the locking means are pressed inwards such that a hooking of the locking means to the wall can be triggered. As a result of this, the operability and practicability of the plug-in connector for a user can be simplified considerably.

Preferably, the plug-in connector also has a liquid discharge groove on the outer circumferential surface of the insulating housing. Liquid, for example water, that has penetrated the plug-in connector can be safely removed from the plug-in connector via this liquid discharge groove.

Another advantageous configuration of the plug-in connector provides for a marking region to be formed on the outer circumferential surface of the insulating housing. The plug-in connector can be labelled on this marking surface such that it is quickly and easily identifiable, especially if there is a plurality of plug-in connectors arranged next to one another.

The invention is described in more detail hereinafter with reference to a preferred embodiment and the accompanying drawings.

In FIG. 1, a plug-in connector according to the invention is shown in a sectional view. The plug-in connector has an insulating housing 1, which is substantially sleeve-shaped and forms the outer shell of the plug-in connector. Inside the insulating housing 1, a free end 2 of a cable 3 is introduced.

The free end 2 of the cable 3 has a first stripped region 4 where the sheath 5 of the cable 3 has been removed and the shield 6 arranged below the sheath 5, which is formed as a braided shield, of the cable 3 is exposed. In this first stripped region 4, a first electrically conductive spring element 7 is arranged on the shield 6. The first spring element 7 is formed in the form of a closed ring and designed as a spiral spring ring, which rests close to the shield 6.

Figure 5:
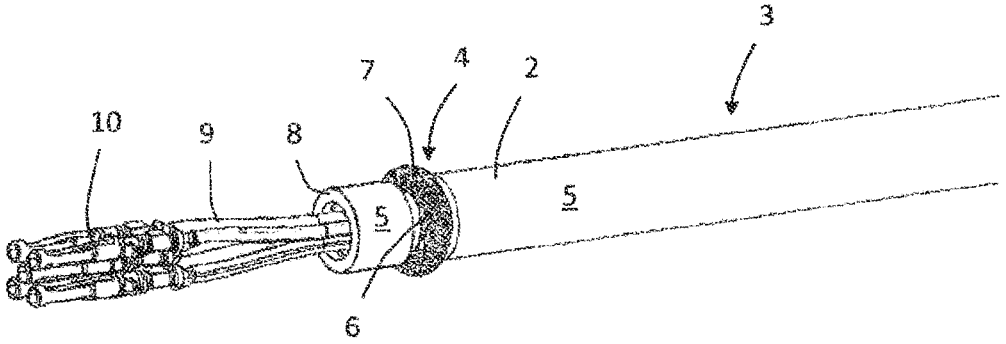
FIG. 5 shows a schematic view of a fourth step in the method for producing the plug-in connector according to the invention shown in FIG. 1.

At one end portion 8 of the free end 2 of the cable 3, a plurality of wires 9 of the cable 3 extend out of the cable 3 and are connected to contact elements 10, as shown in FIG. 5, the contact elements 10 in turn being arranged in an insulating body 11. The insulating body 11 is arranged inside the plug-in connector at a distance from the end portion 8 of the free end 2 of the cable 3.

Between the insulating body 11 and the insulating housing 1, an electrically conductive shield sleeve 12 is arranged, which surrounds the insulating body 11, a second space 13 formed between the insulating body 11 and the end portion 8 of the free end 2 of the cable 3 and the first spring element 7. The shield sleeve 12 extends beyond the spring element 7 both before and after the spring element 7 in the process and is arranged in a sealing manner on the sheath 5 of the cable 3. In the region of the first spring element 7, the shield sleeve 12 rests on the spring element 7 and presses the same towards the shield 6 such that the spring element 7 is tensioned by the shield sleeve 12.

In the region of the insulating body 11 and the second space 13, the shield sleeve 12 is thicker than in the region of the first spring element 7 such that in the region of the insulating body 11 and the second space 13, the shield sleeve 12 rests against the inner wall 14 of the insulating housing 1. An insulation material 28 is injected into a first space 15 formed between the insulating housing 1 and the free end 2 of the cable 3 arranged in the insulating housing 1 and completely fills the first space 15. In the process, the insulation material 28 borders onto an outer circumferential surface of the shield sleeve 12 in the region of the free end 2 of the cable 3 as well as directly onto the sheath 5 of the cable 3 where a shield sleeve 12 is no longer provided.

Furthermore, one or more openings are formed in the shield sleeve 12, via which the insulation material 28 injected into the first space 15 can also flow into the second space 13, which constitutes an interior of the shield sleeve 12, in which the exposed wires 9 of the cable 3 are introduced into the insulating body 12, such that this second space forming the interior of the shield sleeve 12 preferably no longer has any regions filled with air, but rather is completely filled with the insulation material 28. The wires 9 of the cable 3 that have been introduced into the second space are thus embedded in the insulation material 28.

In the first region 4, a third space 33 is formed between the shield 6, the first spring element 7 and the shield sleeve 12, said space not however being filled by the insulation material, but rather in which air is arranged so that the first spring element 7 can be tensioned and released.

Figure 14:
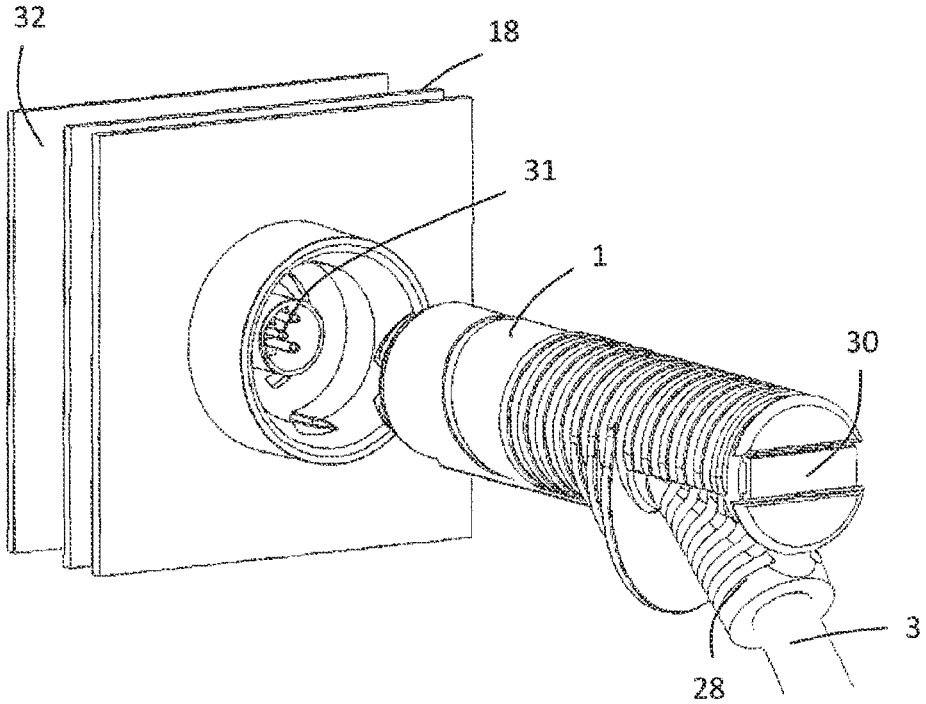
FIG. 14 shows a schematic view of the plug-in connector shown in FIG. 13 with a mating connector.

The shield sleeve 12 is substantially completely surrounded by the insulating housing 1 apart from a region of a free end 16 of the shield sleeve 12. In the region of the free end 16, which is not covered by the insulating housing 1, the shield sleeve 12 has locking means 17 to fasten the plug-in connector to the wall 19, as shown in FIG. 14. The locking means 17 are provided in the form of a plurality of annular locking hooks formed on the end face of the shield sleeve 12.

The insulating housing 1 is mounted so as to be movable on the shield sleeve 12 and also on the insulation material 28 arranged in the first space 15 such that the insulating housing 1 can be moved on the shield sleeve 12 and the insulation material 28, it being possible to activate the locking means 17 during a displacement movement of the insulating housing 12. A dome 19 is formed for this purpose on the outer circumferential surface of the shield sleeve 12 near the locking means 17. An inclined contact surface 20 is provided on the interior wall 14 of the insulating housing 1. If the contact surface 20 of the insulating housing 1 is pushed over the dome 19, the end 16 of the shield sleeve 12 and thus also the locking means 17 are pressed inwards such that a hooking of the locking means 17 with the wall 18 can be triggered.

Furthermore, a second electrically conductive spring element 21 in the form of a closed ring is inserted into a recess 22 formed on the shield sleeve 12 at the free end 16 of the shield sleeve 12. The second spring element 21 is arranged in close proximity to the locking means 17 such that when the locking means 17 lock behind the wall 18, the second spring element 21 exerts such a spring force onto the locking means 17 that the locking means 17 are pressed outwards such that a particularly stable and secure hooking or fastening of the locking means 17 and thus the plug-in connector to the wall 18 is facilitated.

In FIGS. 2 to 12, the individual production steps of a method for producing the plug-in connector shown in FIG. 1 are shown.

Figure 2:
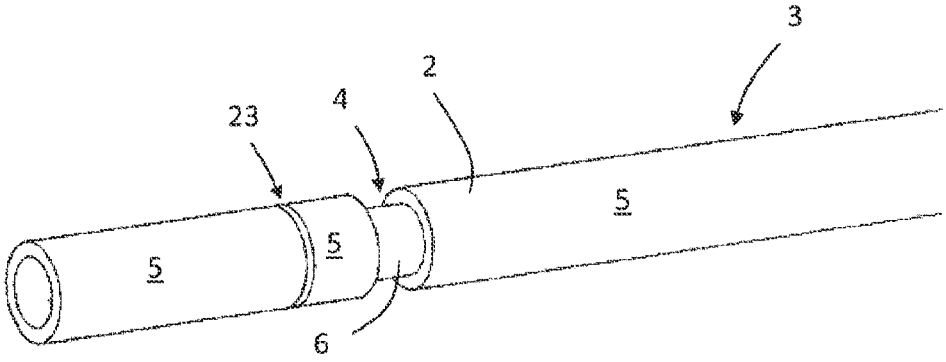
FIG. 2 shows a schematic view of a first step in the method for producing the plug-in connector according to the invention shown in FIG. 1.

As shown in FIG. 2, the sheath 5 of the cable 3 to be inserted into the plug-in connector is first cut into in two regions 4, 23, an incision being made at the first region 4 only to the extent that the sheath 5 is cut into and not the shield 6 below it. At the second region 23, which is at a distance from the first region 4, the shield 6 is also cut into in addition to the sheath 5. Between the first region 4 and the second region 23, the sheath 5 and the shield 6 remain intact on the cable 3.

Figure 3:
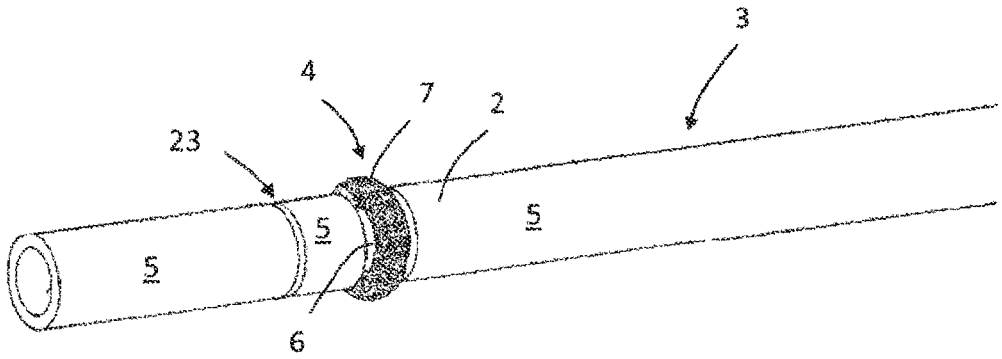
FIG. 3 shows a schematic view of a second step in the method for producing the plug-in connector according to the invention shown in FIG. 1.

In the first region 4, as much of the sheath 5 is removed, as shown in FIG. 3, as will allow the first electrically conductive spring element 7 to be introduced in the first region 4 and rest on the shield 6 of the cable 3 in the introduced state. Before and after the introduced spring element 7, the cable 3 continues to be surrounded by the sheath 5 of the cable 3.

Figure 4:
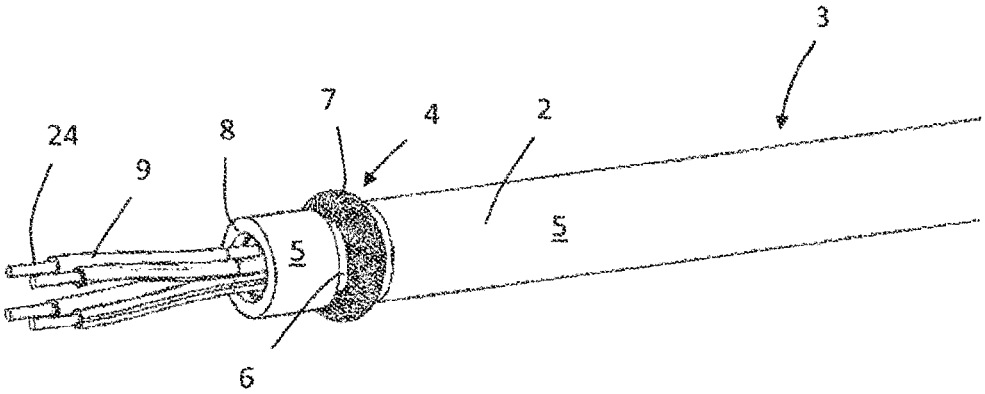
FIG. 4 shows a schematic view of a third step in the method for producing the plug-in connector according to the invention shown in FIG. 1.

The second stripped region 23 forms the end portion 8 of the free end 2 of the cable 3, at which the wires 9 of the cable 3 extend outwards in that by cutting through the sheath 5 and the shield 6 in the second region 23 these are stripped off the cable 3 such that the wires 9 are then exposed in this region, as shown in FIG. 4.

The free ends 24 of the now exposed wires 9 are likewise stripped and connected to contact elements 10 by crimping, as shown in FIG. 5.

Figure 6:
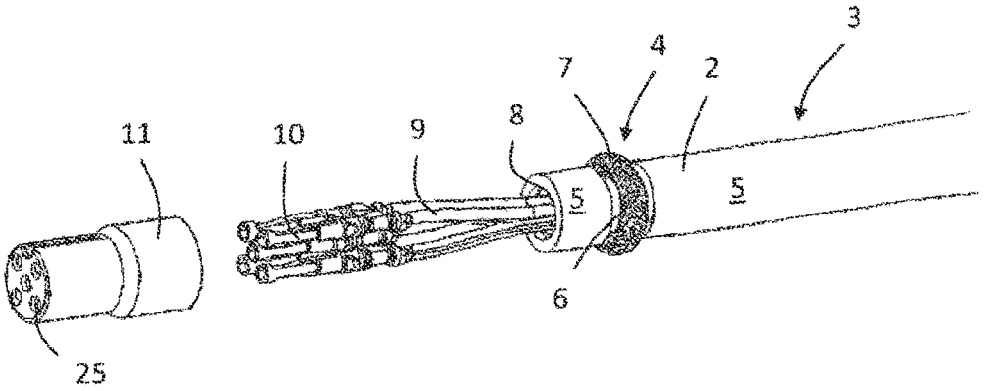
FIG. 6 shows a schematic view of a fifth step in the method for producing the plug-in connector according to the invention shown in FIG. 1.
Figure 7:
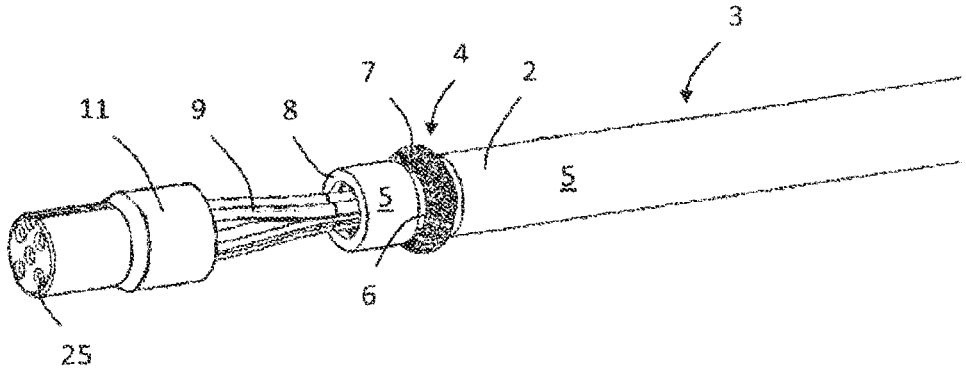
FIG. 7 shows a schematic view of a sixth step in the method for producing the plug-in connector according to the invention shown in FIG. 1.

When the contact elements 10 are tightly connected to the wires 9 of the cable 3, the insulating body 11 is passed over the contact elements 10, as shown in FIG. 6, such that the contact elements 10 are then arranged inside the insulating body 11, as shown in FIG. 7. The insulating body 11 has one through-opening 25 per contact element 10 such that the contact elements 10 are arranged separately from one another in the through-openings 25 in the insulating body 11.

Figure 8:
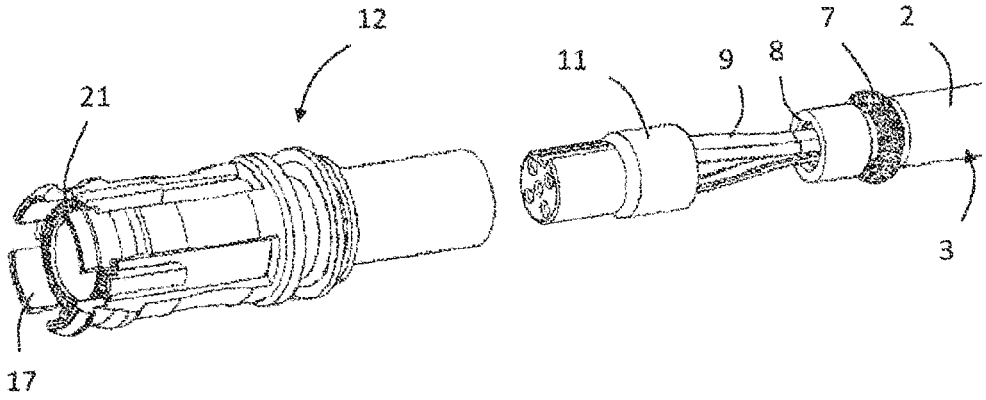
FIG. 8 shows a schematic view of a seventh step in the method for producing the plug-in connector according to the invention shown in FIG. 1.
Figure 9:
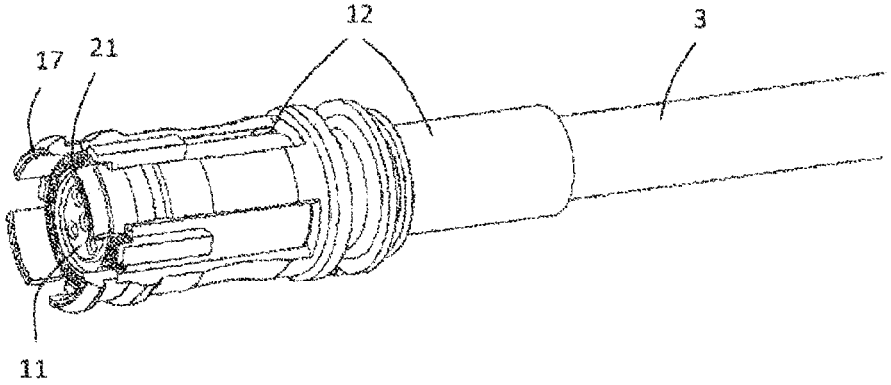
FIG. 9 shows a schematic view of an eighth step in the method for producing the plug-in connector according to the invention shown in FIG. 1.

In a further step as shown in FIG. 8, the electrically conductive shield sleeve 12, which is produced from a metal die casting, for example, is passed over the free end 2 of the cable 3 to the extent that the insulating body 11 and the first spring element 7 are covered by the shield sleeve 12, as shown in FIG. 9.

Figure 10:
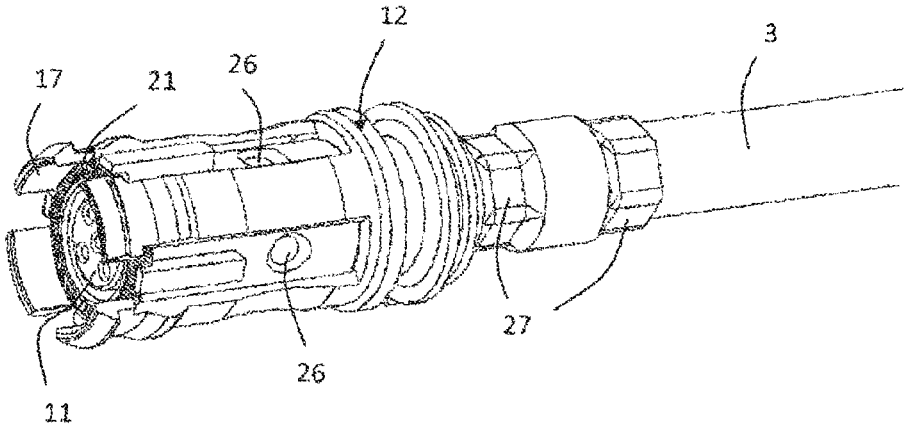
FIG. 10 shows a schematic view of a ninth step in the method for producing the plug-in connector according to the invention shown in FIG. 1.

In order to achieve a non-slip positioning of the shield sleeve 12, the shield sleeve 12 is fastened both to the insulating body 11 and to the sheath 5 of the cable 3 directly before and after the first spring element 7. The fastening is achieved through a crimping procedure, as shown in FIG. 10.

The crimping in the region of the insulating body 11 is performed in a plurality of regions 26 around the outer circumferential surface of the shield sleeve 12, the plurality of crimping regions 26 being at selective points. The plug-in connector shown here has four crimping regions 26, which are formed in a circular path around the outer circumferential surface of the shield sleeve 12. In the crimping regions 26 the shield sleeve 12 is bent towards the insulating body 11, such that the shield sleeve 12 is pressed onto the insulating body 11 in these crimping regions 26.

The crimping in the region of the sheath 5 is carried out by means of a circular pressing of the shield sleeve 12 onto the sheath 5, such that in the crimping regions 27 directly before and after the first spring element 7, the diameter of the shield sleeve 12 is reduced. In the crimping regions 27, the otherwise circular shield sleeve 12 is deformed into a polygon. When the crimping regions 27 are formed, the first spring element 7 can simultaneously be tensioned.

Figure 11:
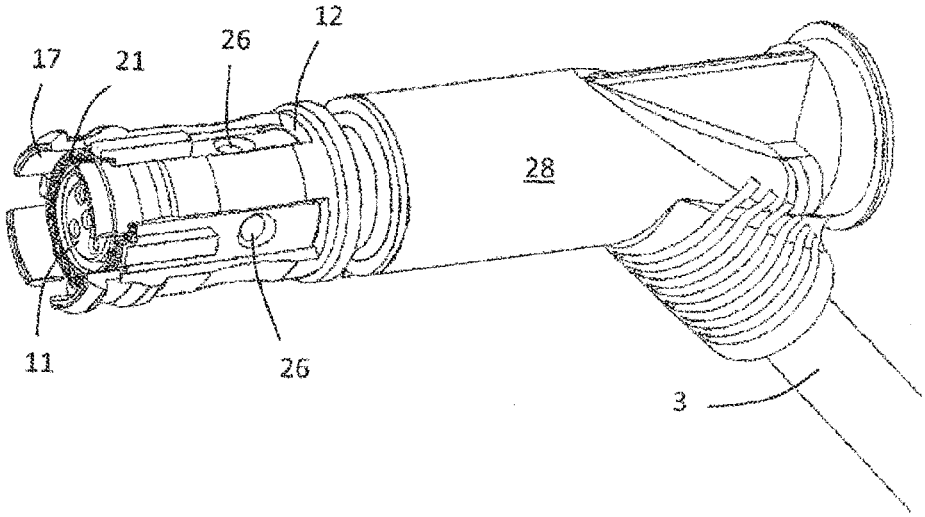
FIG. 11 shows a schematic view of a tenth step in the method for producing the plug-in connector according to the invention shown in FIG. 1.

Afterwards, the injection of the insulation material 28 takes place, the first space 15 and the second space 13 being filled with the insulation material 28. As a result of the injection, the plug-in connector subsequently has an essentially constant diameter since the thickness of the insulation material 28 is adapted to the largest diameter of the shield sleeve 12, as shown in FIG. 11.

Figure 12:
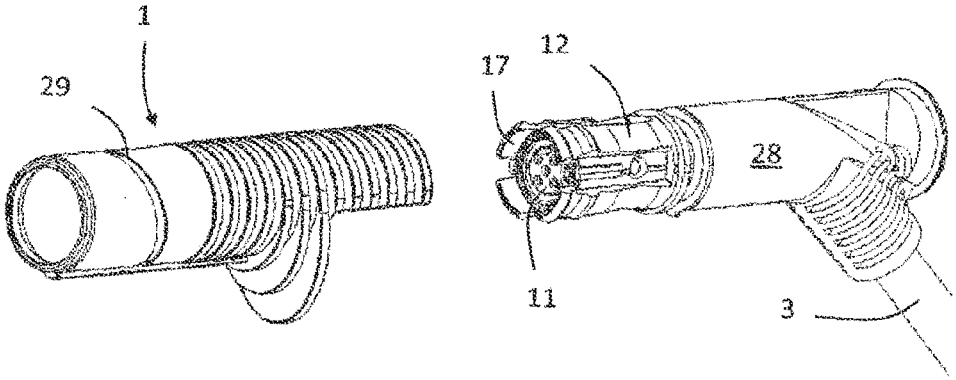
FIG. 12 shows a schematic view of an eleventh step in the method for producing the plug-in connector according to the invention shown in FIG. 1.

Finally, as shown in FIG. 12, the insulating housing 1 is pushed over the shield sleeve 12, which covers the shield sleeve 12 and the free end 2 of the cable 3 surrounded by the insulation material 28 apart from a small region 16.

Figure 13:
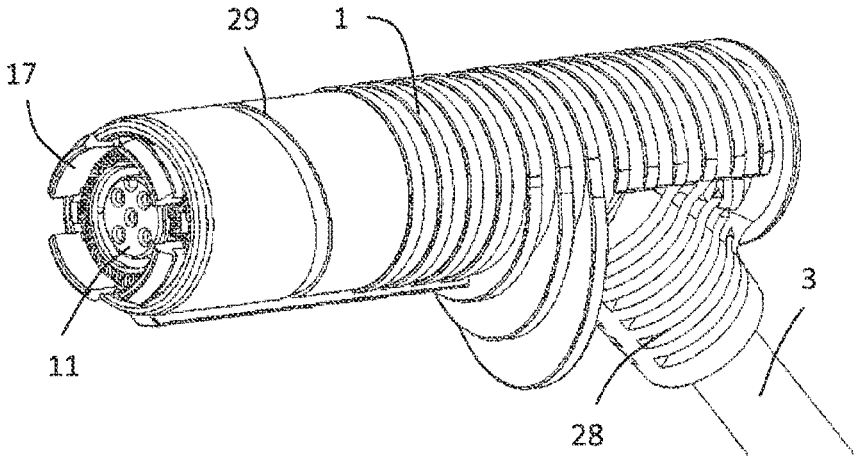
FIG. 13 shows a schematic, perspective view of plug-in connector according to the invention shown in FIG. 1.

The finished plug-in connector is shown in FIG. 13.

Furthermore, on the outer circumferential surface of the insulating housing 1, a liquid discharge groove 29 is formed via which liquid, such as water, can be discharged out of the plug-in connector.

Furthermore, a marking surface 30 is formed on the outer circumferential surface of the insulating housing 1, as shown in FIG. 14, for labelling the plug-in connector.

Moreover, FIG. 14 shows a wall 18 with a mating connector 31, which is arranged here on a circuit board 32, it being possible to connect the plug-in connector to the mating connector 31 so as to form a contact. In order to fasten the plug-in connector to the mating connector 31 the locking means 17 can lock behind the wall 18.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS insulating housing 1
free end 2
cable 3
first region 4
sheath 5
shield 6
first spring element 7
end portion 8
wire 9
contact element 10
insulating body 11
shield sleeve 12
second space 13
inner wall 14
first space 15
free end 16
locking means 17
wall 18
dome 19
contact surface 20
second spring element 21
recess 22
second region 23
free end 24
through-opening 25
crimping region 26
crimping region 27
insulation material 28
liquid discharge groove 29
marking surface 30
mating contact 31
circuit board 32
third space 33

The invention claimed is:

1. A method for producing a plug-in connector, the method comprising:

stripping a cable on a free end of the cable in a first region and a second region of a sheath of the cable, the first and second regions of the sheath and a shield disposed beneath the sheath on the cable being cut through;

disposing a first electrically conductive spring element in the first region;

removing the sheath and the shield from the second region so as to form an end portion of the free end of the cable with exposed wires of the cable;

disposing contact elements on the exposed wires of the cable;

disposing a shield sleeve around the first electrically conductive spring element in the first region;

fastening the shield sleeve on the sheath of the cable on either side of the first electrically conductive spring element; and providing an insulating housing at least partially surrounding the shield sleeve and the free end of the cable.

2. The method as recited in claim 1, wherein the first electrically conductive spring element is an annular spring element, the method further comprising pushing the annular spring element over the free end of the cable.

3. The method as recited in claim 1, wherein the shield sleeve is fastened to the sheath by crimping.

4. The method as recited in claim 1, wherein the first electrically conductive spring element is tensioned when the shield sleeve is fastened to the sheath of the cable.

5. The method as recited in claim 1 further comprising injecting an insulation material into a first space formed between the insulating housing and the free end of the cable disposed inside the insulating housing.

6. The method as recited in claim 5 further comprising forming at least one opening on the shield sleeve via which the insulation material is injected into a second space, the second space constituting the interior of the shield sleeve in which the exposed wires of the cable are introduced.

7. The method as recited in claim 1, wherein the contact elements are introduced into an insulating body.

8. The method as recited in claim 7, wherein the shield sleeve is disposed around the insulating body in addition to being disposed around the first electrically conductive spring element, the shield sleeve being fastened to the insulating body.

9. The method as recited in claim 8, wherein the shield sleeve is fastened to the insulating body by crimping.

10. The method as recited in claim 1 further comprising introducing a second electrically conductive annular spring element into a recess formed on the shield sleeve at a free end of the shield sleeve, the plug-in connector being fastenable to a wall via the shield sleeve.

11. A plug-in connector comprising:

an insulating housing configured to receive a free end of a cable;

a first electrically conductive spring element disposed in a first stripped region of the free end of the cable on which a shield surrounding wires of the cable is disposed;

a plurality of contact elements connected to the wires of the cable; and a shield sleeve surrounding the first electrically conductive spring element, the shield sleeve being fastened to a sheath of the cable on either side of the first electrically conductive spring element.

12. The plug-in connector as recited in claim 11, wherein the first spring element is annular in form.

13. The plug-in connector as recited in claim 11, wherein the first electrically conductive spring element is tensioned by the shield sleeve.

14. The plug-in connector as recited in claim 11, wherein an insulation material is disposed in a first space formed between the insulating housing and the free end of the cable, the free end of the cable being disposed inside the insulating housing.

15. The plug-in connector as recited in claim 14, wherein the shield sleeve further comprises at least one opening formed on the shield sleeve and a second space constituting an interior of the shield sleeve in which exposed wires of the cable are disposed, the second space configured to receive the insulation material via the at least one opening.

16. The plug-in connector as recited in claim 11 further comprising an insulating body configured to receive the contact elements.

17. The plug-in connector as recited in claim 16, wherein the shield sleeve is disposed around the insulating body in addition to being disposed around the first electrically conductive spring element, the shield sleeve being fastened to the insulating body.

18. The plug-in connector as recited in claim 11 further comprising a recess formed on a free end of the shield sleeve, the recess being configured to receive a second electrically conductive annular spring element, the plug-in connector being fastenable to a wall via the shield sleeve.

19. The plug-in connector as recited in claim 18 further comprising a locking mechanism to fasten the plug-in connector to the wall, the locking mechanism formed on the free end of the shield sleeve.

20. The plug-in connector as recited in claim 19, wherein the insulating housing is movably disposed on the shield sleeve, the locking mechanism being activatable during a displacement movement of the insulating housing.

21. The plug-in connector as recited in claim 11, further comprising a liquid discharge groove formed on an outer circumferential surface of the insulating housing.

22. The plug-in connector as recited in claim 11, wherein a marking surface is formed on an outer circumferential surface of the insulating housing.

* * * * *